United States Patent [19]

Katoh

[11] Patent Number: 4,910,980

[45] Date of Patent: Mar. 27, 1990

[54] DOOR LOCK/UNLOCK DETECTOR FOR USE IN THEFT PREVENTION DEVICE FOR AUTOMOBILES

[75] Inventor: Yasuaki Katoh, Fujisawa, Japan

[73] Assignee: Shiroki Kinzoku Kogyo Kabushiki Kaisha, Fujisawa, Japan

[21] Appl. No.: 226,716

[22] Filed: Aug. 1, 1988

[30] Foreign Application Priority Data

Jul. 30, 1987 [JP] Japan ..... 62-191154

[51] Int. Cl.[4] ..... E05B 47/00

[52] U.S. Cl. ..... 70/277; 70/1.5; 70/264; 70/278

[58] Field of Search ..... 70/1.5, 1.7, 237, 263, 70/264, 277, 270

[56] References Cited

U.S. PATENT DOCUMENTS

| | | | |
|---|---|---|---|
| 4,565,994 | 1/1986 | Mochida | 70/1.5 |
| 4,734,693 | 3/1988 | Dluhosch | 70/278 |
| 4,787,223 | 11/1988 | Gotando | 70/264 |

*Primary Examiner*—Robert L. Wolfe

*Attorney, Agent, or Firm*—Schwartz & Weinrieb

[57] ABSTRACT

A door lock/unlock detector for use within a theft prevention device for an automobile includes a door lock cylinder having a key-actuator rotor rotatable between a lock position and an unlock position. A detector plate is mounted upon the key-actuator rotor for rotation therewith. A first detector comprising a reed switch is positioned so as to confront the detector plate when the key-actuator rotor move to the lock position. A second detector comprising a reed switch is positioned so as to confront the detector plate when the key-actuated rotor is moved to unlock position.

6 Claims, 4 Drawing Sheets

DOOR LOCK/UNLOCK DETECTOR FOR USE IN THEFT PREVENTION DEVICE FOR AUTOMOBILES

FIELD OF THE INVENTION

The present invention relates to a door lock/unlock detector for use within a theft prevention device or system for an automobile.

BACKGROUND OF THE INVENTION

Some prior automobile theft prevention devices include a theft prevention switch connected to the starter circuit for an engine. When an automobile door is locked by means of a key or the like from a position outside the automobile, the theft prevention switch is automatically opened so as to make it impossible to subsequently start the engine even if the engine starting switch is turned to the ON position, unless the door is subsequently legally or properly unlocked by means of the key or the like.

Within such an automobile theft prevention device or system, the locking of the door is detected by means of a door lock/unlock detector associated with a door lock device or a linkage mechanism coupled to the door lock device.

It has been tedious and time-consuming to install the door lock/unlock detector in its proper operative position since the door lock device or the linkage mechanism has its components arranged in a complex manner and at a position at which the door lock/unlock detector is to be located, and in addition, since a member to be detected by means of the door lock/unlock detector is displaced in accordance with a complex movement pattern.

OBJECTS OF THE INVENTION

It is an object of the present invention to provide a door lock/unlock detector which can easily and efficiently be installed at its operative position.

Another object of the present invention is to provide a door lock/unlock detector which can be easily and efficiently incorporated within a door lock cylinder without a substantial modification of the door lock cylinder, so that a theft prevention device may be operatively asociated with an existing door lock cylinder.

SUMMARY OF THE INVENTION

According to the present invention, there is provided a door lock/unlock detector for use within a theft prevention device or system for an automobile, including a door lock cylinder having a key-actuated rotor rotatable between a lock position and an unlock position, comprising a detector plate adapted to be rotatable with the key-actuated rotor, a first detector positioned so as to confront the detector plate when the key-actuated rotor is disposed at the lock position, and a second detector positioned to confront the detector plate when the key-actuated rotor is in the unlock position.

BRIEF DESCRIPTION OF THE DRAWINGS

The above and other objects, features and advantages of the present invention will become more apparent from the following description when taken in conjunction with the accompanying drawings in which a preferred embodiment of the present invention is shown by way of the illustrative example, and wherein.

DETAILED DESCRIPTION OF THE PREFERRED EMBODIMENT

Figure 6:
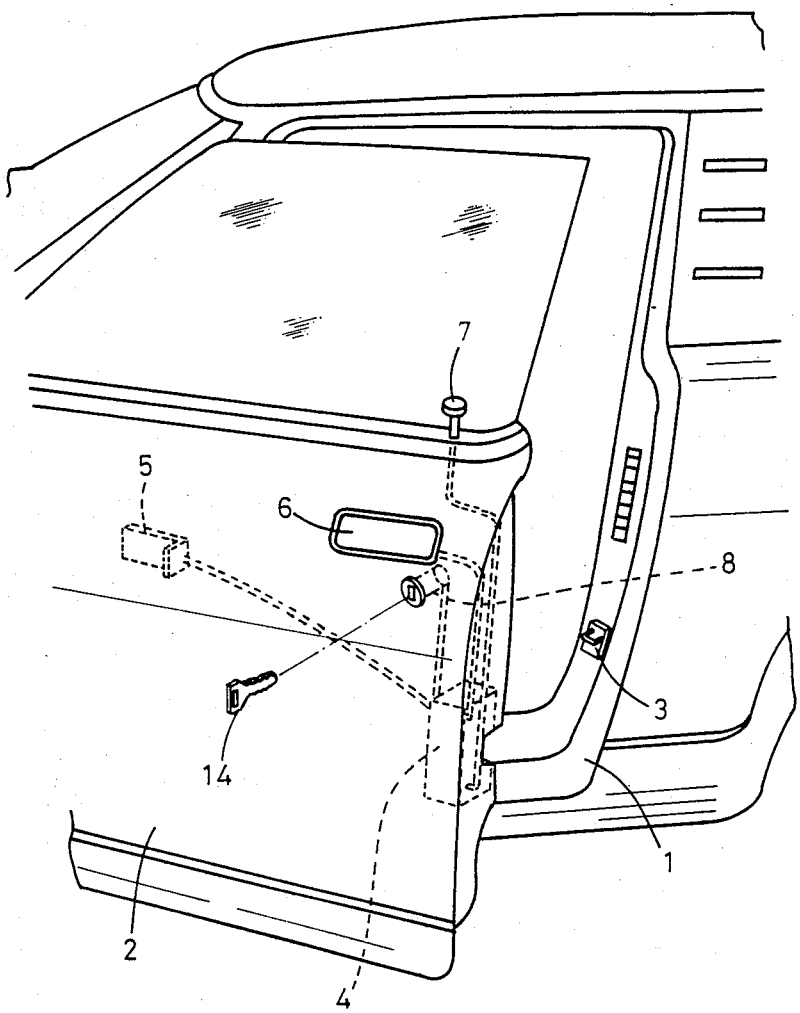
FIG. 6 is a fragmentary perspective view of an automobile door operating assembly.

An overall automobile door operating assembly will first be described with reference to FIG. 6.

An automobile passenger compartment door 2 and a striker 3 are mounted upon an automobile body 1, and a door lock device 4 is mounted within the door 2 at a position corresponding to the striker 3 mounted upon the automobile body 1.

When the door 2 is unlocked, the door lock device 4 allows the door 2 to be opened by means of actuation of either an inside handle 5 or an outside handle 6. When the door 2 is locked, however, the door lock device 4 maintains the door 2 closed even if the inside handle 5 or the outside handle 6 is operated or actuated in an otherwise opening mode. The locked door 2 can be unlocked by releasing the door lock device 4 by means of an inside knob 7 or by means of a key-actuated door lock cylinder 8.

The door lock cylinder 8 is operatively associated with a door lock/unlock device which will be described below. A theft prevention switch within an engine starter circuit can be opened and closed by means of a door lock/unlock signal received from the door lock/unlock device.

Figure 1:
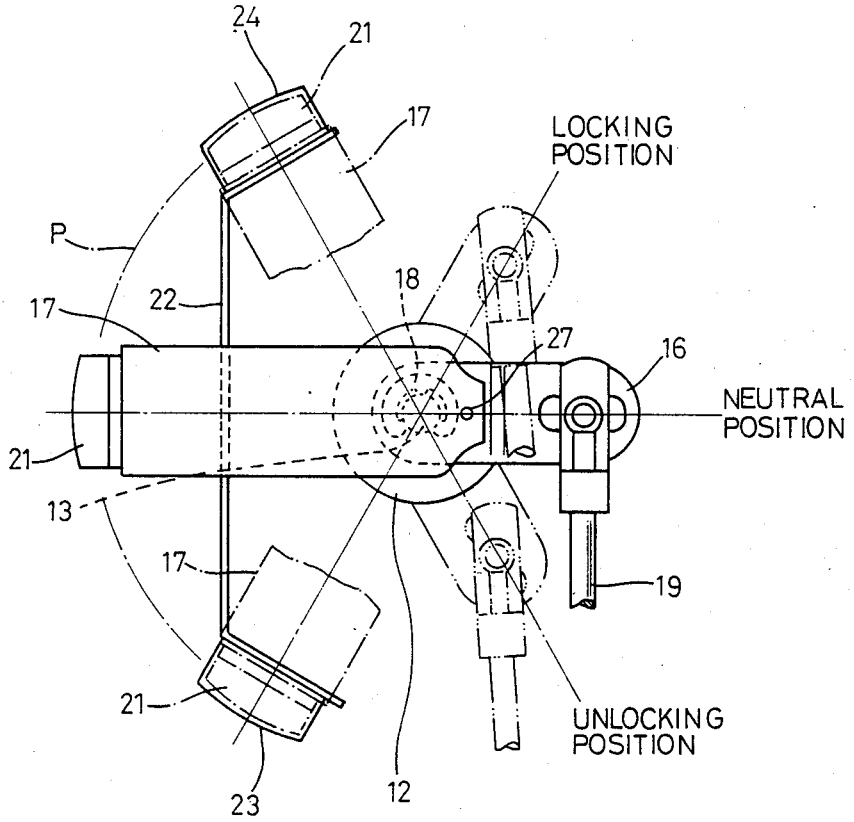
FIG. 1 is a view of a door lock cylinder as viewed in the direction of the arrow I in FIG. 2.
Figure 2:
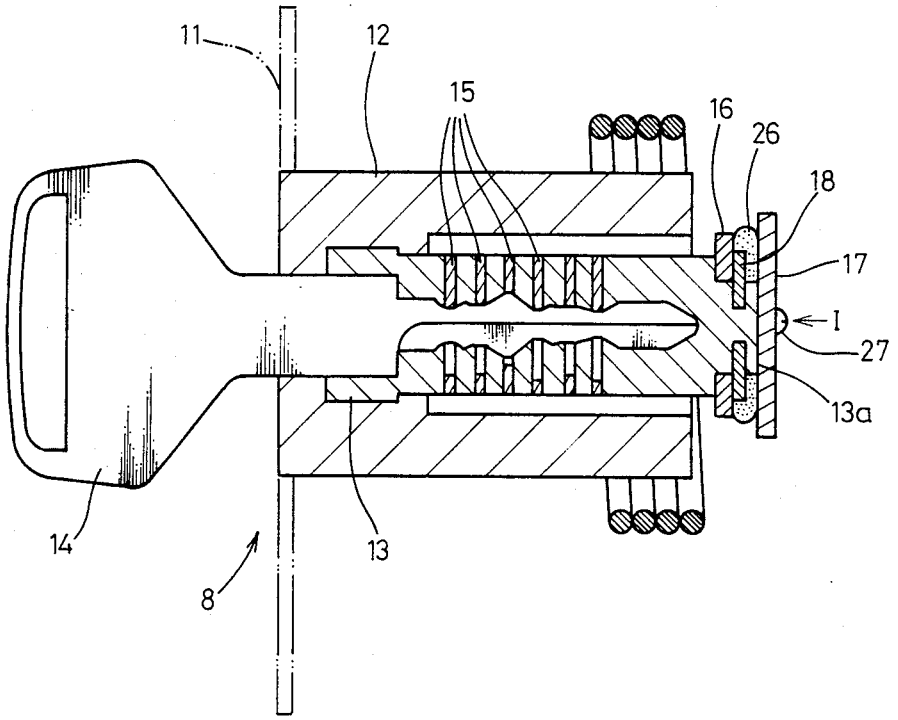
FIG. 2 is a longitudinal cross-sectional view of the door lock cylinder.

As shown in FIGS. 1 and 2, the door lock cylinder 8 comprises a key cylinder 12 mounted upon a door panel 11, a key-actuated rotor 13 rotatably supported within the key cylinder 12, and a key-actuated 14 for rotating the key-actuated rotor 13. The key rotor 13 has a distal end 13*a* projecting from the distal end of the key cylinder 12.

The key-actuated rotor 13 has a plurality of tumblers 15 slidably disposed therein. When the key 14 which matches the door lock cylinder 8 is inserted into the key-actuated rotor 13, the tumblers 15 are disposed in their proper positions with respect to the key cylinder 12 so as to allow the key-actuated rotor 13 to rotate about its longitudinal axis.

An operating plate 16 is mounted upon the distal end 13*a* of the key-actuated rotor 13 for transmitting angular displacement of the key-actuated rotor 13 caused by means of the key 14 to the door lock device 4 so as to lock or unlock the door 2, the operating plate 16 being retained in position upon the distal end 13*a* of rotor 13 by means of an E-ring 18. A detector plate 17 is attached at one end thereof to the operating plate 16 by means of an adhesive 26 and a self-tapping screw 27 driven into the distal end 13*a* of the key-actuated rotor 13. An operating rod 19, mounted upon an end of a linkage mechanism coupled to the lock within the door lock device 4, is connected to the operating plate 16 for locking and unlocking the door lock device 4.

Figure 3:
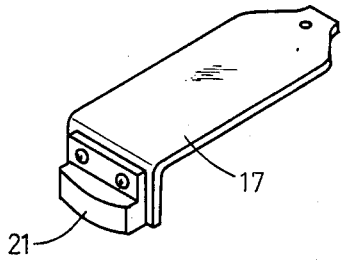
FIG. 3 is a perspective view of a detector plate used within the detector system of the present invention.

As shown in FIG. 3, a magnet 21 is fixed to the other end of the detector plate 17 for detecting the angular position of the detector plate 17. The magnet 21 is angularly displaced along an arcuate path P as the key-actuated rotor 13 rotates.

Detectors, described below, positioned behind the path P as shown in FIG. 1 are supported upon a retainer 22 by which the outer periphery of the door lock cylinder 8 (key cylinder 12) is fixed to the door panel 11.

Figure 4:
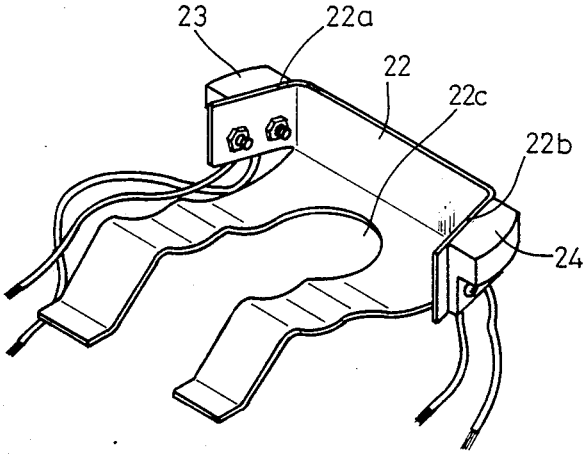
FIG. 4 is a perspective view of a retainer for the proximity switches employed within the detector system of the present invention.

As illustrated in FIG. 4, the retainer 22 is stamped from a steel sheet and subsequently bent so as to have upon its opposite ends a pair of seats 22*a*, 22*b* upon which there are mounted the detectors which comprise proximity switches (reed switches) 23, 24, respectively. These seats 22*a*, 22*b* are positioned upon a circle around a door lock cylinder attachment hole 22*c* defined within the retainer 22. More specifically, the proximity swtiches 23, 24 are positioned as shown in FIG. 1 upon the path. When the door 2 is locked, the magnet 21 upon the detector plate 17 confronts the proximity switch 23, whereas when the door 2 is unlocked, the magnet 21 confronts the proximity switch 24.

Figure 5:
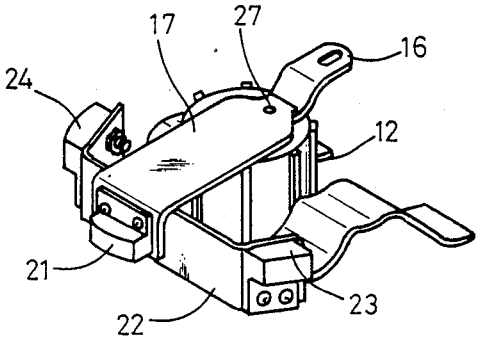
FIG. 5 is a perspective view of the door lock cylinder with the detector of the present invention attached thereto.

Operation of the door lock/unlock detector will be described below. The detector plate 17 is angularly moved by means of the key 14 from the neutral position shown in FIG. 5, that is, the position at which the magnet 21 is positioned intermediate between the proximity switches 23, 24, toward one of the proximity switches 23, 24 until the proximity switch is turned ON. Therefore, the proximity switches 23, 24 can produce a signal indicating whether the door 2 is locked or unlocked.

In this embodiment, the magnet 21 is mounted upon the detector plate 17 because the reed switches 23, 24 are employed as detectors. Where limit switches are employed as detectors, the magnet 21 can be dispensed with.

The key cylinder 12 is supported upon the retainer 22 extending around the key cylinder 12 and the proximity switches 23, 24 are also supported upon the retainer 22. Therefore, when mounting the key cylinder 12 upon the door panel 11, the proximity switches 23, 24 are first installed upon the retainer 22, and then the key cylinder 12 is attached to the retainer 22, thus providing a subassembly, which is then mounted upon the door panel 11. Therefore, the proximity switches 23, 24 can easily and efficiently be assembled in place.

Only the operating plate 16 and the operating rod 19 are disposed around the door lock cylinder 8 which includes the detector plate 17 and the retainer 22. Thus the door lock/unlock detector can be easily installed in position since the space for installing the door lock/unlock detector is relatively easily maintained.

The detector plate 17 is attached to the distal end 13*a* of the key-actuated rotor 13 and the internal structure of the key cylinder 12 does not need to be modified in any way. Accordingly, the door lock/unlock detector can be combined with an existing door lock cylinder 8 of the general type by only slightly modifying the door lock cylinder 8.

The detector plate 17 is angularly displaced along the simple arcuate path P around the key-actuated rotor 13. The angular displacement of the detector plate 17 can thus easily be detected simply by supporting the proximity switches 23, 24 upon the retainer 22.

Although a certain preferred embodiment has been shown and described, it should be understood that many changes and modifications may be made therein without departing from the scope of the appended claims.

What is claimed is:

1. A door lock/unlock detector for use in a theft prevention device for an automobile, which includes an engine starter circuit and a door lock mechanism, comprising:

a door lock cylinder;

a key rotor rotatably mounted within said door lock cylinder between a first lock position and a second unlock position;

detector plate means mounted upon said key rotor so as to be rotatable with said key rotor between said first lock position and said second unlock position;

first detector means positioned so as to confront one end of said detector plate means when said key rotor and said detector plate means are moved to said lock position for detecting said lock position and for generating a first electrical signal for disabling said engine starter circuit of said automobile;

second detector means positioned so as to confront said one end of said detector plate means when said key rotor and said detector plate means are moved to said unlock position for detecting said unlock position and for generating a second electrical signal for enabling said engine starter circuit of said automobile; and linkage means connected, at one end thereof to an opposite end of said detector plate means, and at an opposite end thereof to said door lock mechanism of said automobile, so as to be movable with said detector plate means, and thereby activate and deactivate said door lock mechanism of said automobile, in response to said rotatable movement of said detector plate means when rotated by said key rotor between said first lock position and said second unlock position.

2. A door lock/unlock detector according to claim 1, further comprising a retainer having a hole for attaching the door cylinder lock, said first and second detectors being supported on said retainer.

3. A door lock/unlock detector according to claim 2, wherein each of said first and second detectors comprises a reed switch, further comprising a magnet mounted on said detector plate.

4. A detector as set forth in claim 1, wherein:

said first and second detector means comprise proximity switches.

5. A detector as set forth in claim 2, wherein:

said first and second detector means are disposed upon said retainer at predetermined locations along a circular locus.

6. A detector as set forth in claim 2, wherein:

said retainer comprises a sheet metal blank having bent end portions; and said first and second detector means are respectively mounted upon said bent end portions.

* * * * *